US011594199B2

(12) United States Patent
Yung et al.

(10) Patent No.: US 11,594,199 B2
(45) Date of Patent: Feb. 28, 2023

(54) ELECTRONIC DEVICE WITH MULTIPLE AMBIENT LIGHT SENSORS

(71) Applicant: Apple Inc., Cupertino, CA (US)

(72) Inventors: Amanda K Yung, Sunnyvale, CA (US); Paul V Johnson, San Francisco, CA (US); Daniel P Kumar, Fremont, CA (US); Jiaying Wu, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/731,755

(22) Filed: Apr. 28, 2022

(65) Prior Publication Data

US 2022/0351704 A1 Nov. 3, 2022

Related U.S. Application Data

(60) Provisional application No. 63/182,467, filed on Apr. 30, 2021.

(51) Int. Cl.
*G09G 5/10* (2006.01)

(52) U.S. Cl.
CPC ..... *G09G 5/10* (2013.01); *G09G 2320/0626* (2013.01); *G09G 2360/144* (2013.01); *G09G 2360/16* (2013.01)

(58) Field of Classification Search
CPC ..... G09G 5/10; G09G 2320/0626; G09G 2360/144; G09G 2360/16
See application file for complete search history.

(56) References Cited

U.S. PATENT DOCUMENTS

| | | | | |
|---|---|---|---|---|
| 6,795,137 | B1 | 9/2004 | Whitted et al. | |
| 9,530,342 | B2 | 12/2016 | Bell et al. | |
| 10,586,482 | B1 * | 3/2020 | Yung | G09G 3/2003 |
| 11,030,946 | B1 * | 6/2021 | Chen | G09G 3/20 |
| 2008/0078921 | A1 | 4/2008 | Yang et al. | |
| 2014/0132578 | A1 * | 5/2014 | Zheng | G01J 1/4228 345/207 |
| 2015/0062186 | A1 | 3/2015 | Park | |
| 2016/0005362 | A1 | 1/2016 | Chen et al. | |
| 2016/0372053 | A1 * | 12/2016 | Lee | G09G 3/342 |
| 2017/0229059 | A1 | 8/2017 | Bonnier et al. | |

FOREIGN PATENT DOCUMENTS

KR 102100768 B1 4/2020

* cited by examiner

*Primary Examiner* — Antonio Xavier
(74) *Attorney, Agent, or Firm* — Treyz Law Group, P.C.; Kendall P. Woodruff

(57) ABSTRACT

An electronic device such as a cellular telephone or other device may have a housing with front and rear faces joined by a sidewall. A display may be mounted on the front face. The electronic device may include multiple ambient light sensors such as a front ambient light sensor on the front face and one or more supplemental ambient light sensors on the rear face and/or on the sidewall. The front ambient light sensor gathers a front ambient light intensity measurement and the supplemental ambient light sensor gathers a supplemental ambient light intensity measurement. During operation, control circuitry in the electronic device adjusts the display brightness based on data from the ambient light sensors. The control circuitry may implement power saving restrictions that limit when the supplemental ambient light intensity measurement is taken into account and/or that impose a brightness cap on the display brightness.

17 Claims, 5 Drawing Sheets

ELECTRONIC DEVICE WITH MULTIPLE AMBIENT LIGHT SENSORS

This application claims the benefit of U.S. provisional patent application No. 63/182,467, filed Apr. 30, 2021, which is hereby incorporated by reference herein in its entirety.

FIELD

This relates generally to electronic devices, and, more particularly, to electronic devices with displays.

BACKGROUND

Electronic devices such as cellular telephones, tablet computers, and other equipment are sometimes provided with light sensors. For example, ambient light sensors may be incorporated into a device to provide the device with information on current lighting conditions. Ambient light readings may be used in controlling an electronic device. For example, the brightness of a display may be increased in bright ambient light conditions and decreased in dim ambient light conditions.

In conventional electronic devices, ambient light readings may not accurately represent the ambient light conditions perceived by a user, which can cause the display to appear too dim or too bright in certain situations.

SUMMARY

An electronic device such as a cellular telephone, tablet computer, or other device may have an electronic device housing with front and rear faces joined by a sidewall. The electronic device may include multiple ambient light sensors such as a front ambient light sensor on the front face and a supplemental ambient light sensor on the rear face, sidewall, or other surface of the electronic device.

A front ambient light sensor may gather a front ambient light intensity measurement, and a supplemental ambient light sensor may gather a supplemental ambient light intensity measurement. During operation, control circuitry in the electronic device may take action based on data from the ambient light sensors. For example, the brightness of a display may be adjusted and/or other display adjustments may be made.

The control circuitry may implement power saving restrictions that limit when the supplemental ambient light intensity measurement is taken into account and/or that impose a brightness cap on the display brightness.

DETAILED DESCRIPTION

An electronic device may include one or more displays and one or more ambient light sensors. The ambient light sensors may be mounted on a front surface of the electronic device, a rear surface of the electronic device, a side surface of the electronic device (e.g., a top sidewall, a bottom sidewall, a left sidewall, a right sidewall, etc.). The ambient light sensors may gather ambient light intensity readings that may be used to adjust the brightness of a display in the electronic device.

If desired, one or more of the ambient light sensors in an electronic device may be color ambient light sensors that make measurements of light intensity in multiple color channels (e.g., multiple different overlapping visible light wavelength ranges) and that use this information in producing ambient light color information. The ambient light color information may be provided in the form of color coordinates in a desired color space, a color temperature, a correlated color temperature, a color spectrum, and/or other color data format. Configurations in which ambient light color measurements are made using color coordinates may sometimes be described herein as an example.

Figure 1:
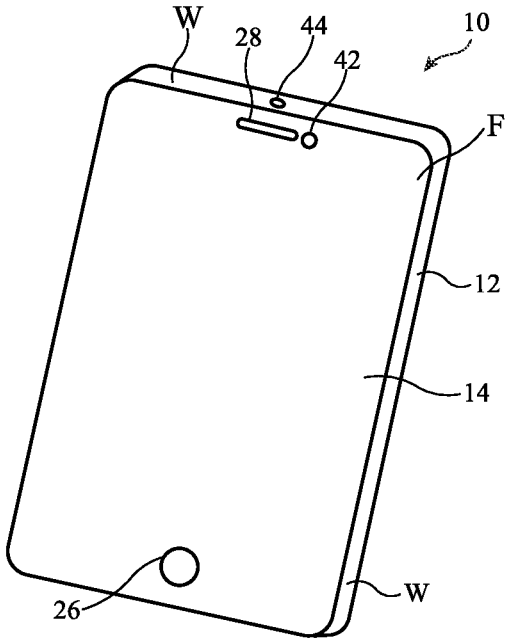
FIG. 1 is a front perspective view of an illustrative electronic device having a display, a front ambient light sensor, and one or more supplemental ambient light sensors in accordance with an embodiment.

FIG. 1 is a perspective view of an illustrative electronic device having one or more ambient light sensors. As shown in FIG. 1, electronic device 10 may have a housing such as housing 12 that supports a display such as display 14. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). If desired, housing 12 may form an enclosure for a cellular telephone or a tablet computer. Configurations in which housing 12 forms an enclosure for other types of electronic devices such laptop computers, desktop computers, wristwatch devices, and/or other devices may also be used.

Device 10 has opposing front and rear faces joined by sidewalls. In the illustrative configuration of FIG. 1, display 14 may be mounted on front face F of device 10. A transparent portion of housing 12, which may sometimes be referred to as a display cover layer, may cover display 14 on front face F. The display cover layer portion of housing 12 may be formed from a layer of transparent glass, clear plastic, sapphire, or other clear layer.

Figure 2:
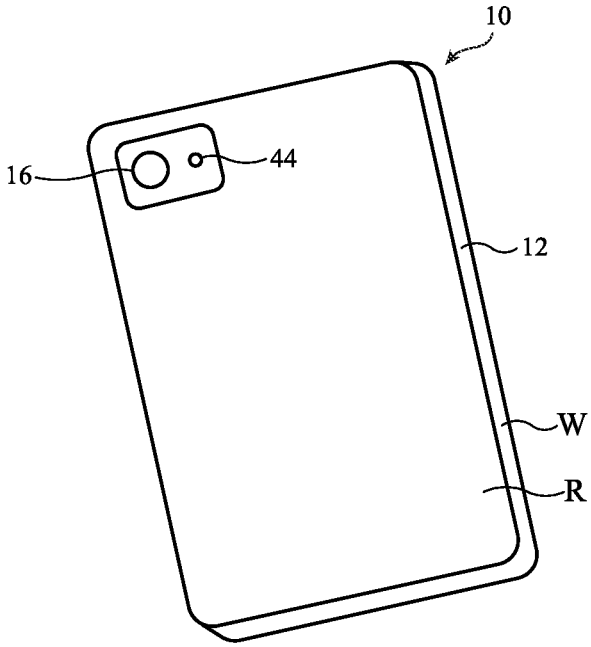
FIG. 2 is a rear perspective view of an illustrative electronic device of the type shown in FIG. 1 having one or more supplemental ambient light sensors in accordance with an embodiment.

A rear perspective view of device 10 (e.g., device 10 of FIG. 1) is shown in FIG. 2. As shown in FIG. 2, housing 12 may have portions that form a rear wall on rear face R of device 10 and portions that form sidewalls W (e.g., curved and/or planar sidewalls) for device 10.

Ambient light sensors and other components may be mounted within housing 12. With one illustrative configuration, which is sometimes described herein as an example, a first ambient light sensor such as front ambient light sensor 42 is mounted on front face F of housing 12. One or more additional ambient light sensors such as supplemental ambient light sensor 44 may be mounted on one or more of sidewalls W (e.g., a top sidewall W on an upper portion of housing 12, as shown in FIG. 1) and/or may be mounted on rear face R of housing 12 (e.g., as shown in FIG. 2). This is merely illustrative, however. If desired, supplemental ambient light sensor 44 may be mounted on sidewall W instead of or in addition to mounting supplemental ambient light sensor 44 on rear face R, or supplemental ambient light sensor 44 may be mounted on rear face R without any supplemental ambient light sensors 44 on sidewalls W.

In one illustrative configuration, device 10 includes a front ambient light sensor 42 on front face F of device 10 and a supplemental ambient light sensor 44 (sometimes referred to as a rear ambient light sensor) on rear face R of device 10. The front and rear ambient light sensors face opposing (opposite) directions and gather ambient light measurements in opposing directions. Other arrangements in which device 10 has multiple ambient light sensors may be used, if desired.

Display 14 may include an array of display pixels formed from liquid crystal display (LCD) components, an array of electrophoretic pixels, an array of plasma pixels, an array of organic light-emitting diode pixels or other light-emitting diodes, an array of electrowetting pixels, or pixels based on other display technologies. The array of pixels of display 14 forms an active area that displays images for a user of device 10. The active area may be rectangular or may have other suitable shapes. The active area may cover all of front face F or an inactive border area may run along one or more edges of the active area and/or may form isolate island(s) within the active area. An ambient light sensor may be mounted in an area of front face F that is adjacent to the pixels of display 14 (e.g., outside of the active area of display 14) or that operates through a window within the pixels of display 14 (e.g., inside the active area of display 14).

During operation, control circuitry in device 10 may be used in processing ambient light measurements and taking appropriate action. For example, ambient light data (e.g., ambient light intensity and/or ambient light color) may be used in determining how to adjust display intensity and/or display color. Display color adjustments, which may sometimes be referred to as color cast adjustments or white point adjustments, may be made to adjust the color cast of images on display 14 (e.g., to make images appear warmer or cooler, more or less greenish, more or less blue, more or less yellow, etc.). The ambient light measurements that are obtained by the control circuitry in device 10 may be obtained from ambient light sensors mounted on front face F of device 10, rear face R of device 10, and/or one or more of sidewalls W of device 10.

Figure 3:
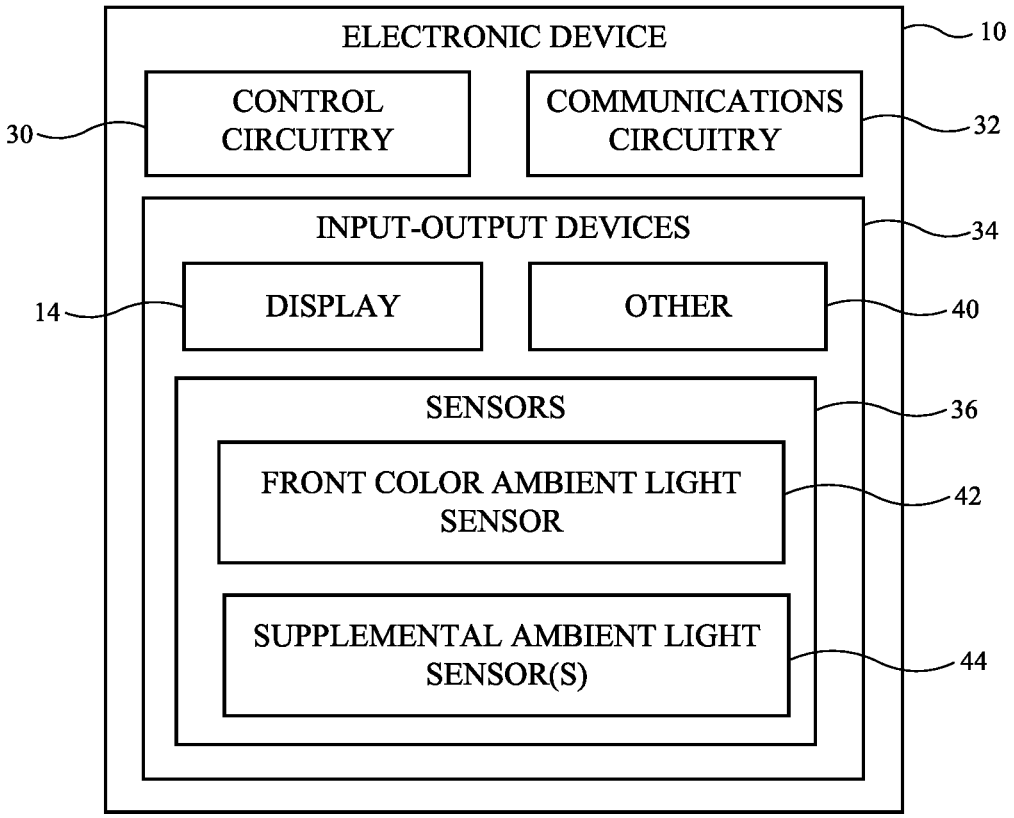
FIG. 3 is a schematic diagram of an illustrative electronic device with a front ambient light sensor and one or more supplemental ambient light sensors in accordance with an embodiment.

A schematic diagram of an illustrative electronic device 10 of the type that may be provided with one or more light sensors is shown in FIG. 3.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

As shown in FIG. 3, device 10 may include control circuitry 30, communications circuitry 32, and input-output devices 34.

Control circuitry 30 may include storage and processing circuitry for supporting the operation of device 10. The storage and processing circuitry may include storage such as nonvolatile memory (e.g., flash memory or other electrically-programmable-read-only memory configured to form a solid state drive), volatile memory (e.g., static or dynamic random-access-memory), etc. Processing circuitry in control circuitry 30 may be used to gather input from sensors and other input devices and may be used to control output devices. The processing circuitry may be based on one or more microprocessors, microcontrollers, digital signal processors, baseband processors and other wireless communications circuits, power management units, audio chips, application specific integrated circuits, etc.

To support communications between device 10 and external electronic equipment, control circuitry 30 may communicate using communications circuitry 32. Communications circuitry 32 may include antennas, radio-frequency transceiver circuitry, and other wireless communications circuitry and/or wired communications circuitry. Circuitry 32, which may sometimes be referred to as control circuitry and/or control and communications circuitry, may, for example, support wireless communications using wireless local area network links, near-field communications links, cellular telephone links, millimeter wave links, and/or other wireless communications paths.

Input-output devices 34 may be used in gathering user input, in gathering information on the environment surrounding the user, and/or in providing a user with output. Input-output devices 34 in device 10 may include display 14 (e.g., a display mounted on front face F of housing 12). Display 14 has an array of pixels for displaying images to users. Display 14 may be a light-emitting diode display (e.g., an organic light-emitting diode or a display with a pixel array having light-emitting diodes formed from crystalline semiconductor dies), an electrophoretic display, a liquid crystal display, or other display. Display 14 may include a two-dimensional capacitive touch sensor or other touch sensor for gathering touch input or display 14 may be insensitive to touch. Haptic elements may be used to provide haptic feedback (e.g., haptic feedback in response to display touch sensor input, etc.).

Devices 34 may include sensors 36. Sensors 36 may include force sensors (e.g., strain gauges, capacitive force sensors, resistive force sensors, etc.), audio sensors such as microphones, capacitive touch sensors, capacitive proximity sensors, non-capacitive touch sensors, ultrasonic sensors, sensors for detecting position, orientation, and/or motion (e.g., accelerometers, magnetic sensors such as compass sensors, gyroscopes, and/or inertial measurement units that contain some or all of these sensors), muscle activity sensors (EMG), heart rate sensors, electrocardiogram sensors, and other biometric sensors, radio-frequency sensors (e.g., radar and other ranging and positioning sensors), humidity sensors, moisture sensors, and/or other sensors.

Sensors 36 and other input-output devices 34 may include optical components such as light-emitting diodes (e.g., for camera flash or other blanket illumination, etc.), lasers such as vertical cavity surface emitting lasers and other laser diodes, laser components that emit multiple parallel laser beams (e.g., for three-dimensional sensing), lamps, and light sensing components such as photodetectors and digital image sensors. For example, sensors 36 in devices 34 may include optical sensors such as depth sensors (e.g., structured light sensors and/or depth sensors based on stereo imaging devices that can optically sense three-dimensional shapes), optical sensors such as self-mixing sensors and light detection and ranging (lidar) sensors that gather time-of-flight measurements and/or other measurements to determine distance between the sensor and an external object and/or that can determine relative velocity, proximity sensors based on light (e.g., optical proximity sensors that include light sources such as infrared light-emitting diodes and/or lasers and corresponding light detectors such as infrared photodetectors that can detect when external objects are within a predetermined distance), optical sensors such as visual odometry sensors that gather position and/or orientation information using images gathered with digital image sensors in cameras, gaze tracking sensors, visible light and/or infrared cameras having digital image sensors configured to gather image data, optical sensors for measuring ultraviolet light, and/or other optical sensor components (e.g., light sensitive devices and, if desired, light sources), photodetectors coupled to light guides, associated light emitters, and/or other optical components (one or more light-emitting devices, one or more light-detecting devices, etc.).

The optical sensors of sensors 36 may include color ambient light sensors that can measure ambient light levels. Each color sensor may have multiple photodetectors (e.g., photodiodes) covered with respective color filters corresponding to multiple respective color channels. The color filters may be configured to pass light of different colors (e.g., a red filter may pass red light for detection by a red photodiode in a red ambient light sensor channel, a blue filter may pass blue light for detection by a blue photodiode in a blue ambient light sensor channel, etc.). There may be, for example, 3-8 overlapping channels, at least 3 channels, at least 5 channels, fewer than 10 channels, or other suitable number of channels in each color ambient light sensor.

As shown in FIG. 3, the ambient light sensors of device 10 may include front color ambient light sensor 42, which may sometimes be referred to as a front sensor or front light sensor, and one or more additional ambient light sensors such as supplemental ambient light sensor 44, which may sometimes be referred to as a rear light sensor (e.g., in arrangements where sensor 44 is mounted to rear wall R of device 10) or a sidewall light sensor or side light sensor (e.g., in arrangements where sensor 44 is mounted on a sidewall W of device 10). The ambient light sensors in device 10 may face in different directions and/or may have different angles of view, thereby helping device 10 to satisfactorily sense the intensity and/or color of light in the user's environment. For example, sensors 42 and 44 may face in opposite directions and/or orthogonal directions, and/or two or more or three or more ambient light sensors in device 10 may otherwise face in different directions to allow light readings from different directions to be used in determining how to adjust the white point of display 14.

One or more of ambient light sensors 42 and 44 may be color ambient light sensors. In some arrangements, only front ambient light sensor 42 may be color-sensitive while supplemental ambient light sensor 44 may be configured to measure light intensity without measuring light color. In other arrangements, both front light sensor 42 and supplemental light sensor 44 may be color-sensitive. Arrangements in which supplemental light sensor 44 is color-sensitive and front ambient light sensor 42 is not color-sensitive may also be used, if desired.

If desired, device 10 may include other components 40 such as audio components, power components, batteries, haptic devices, etc.

Figure 4:
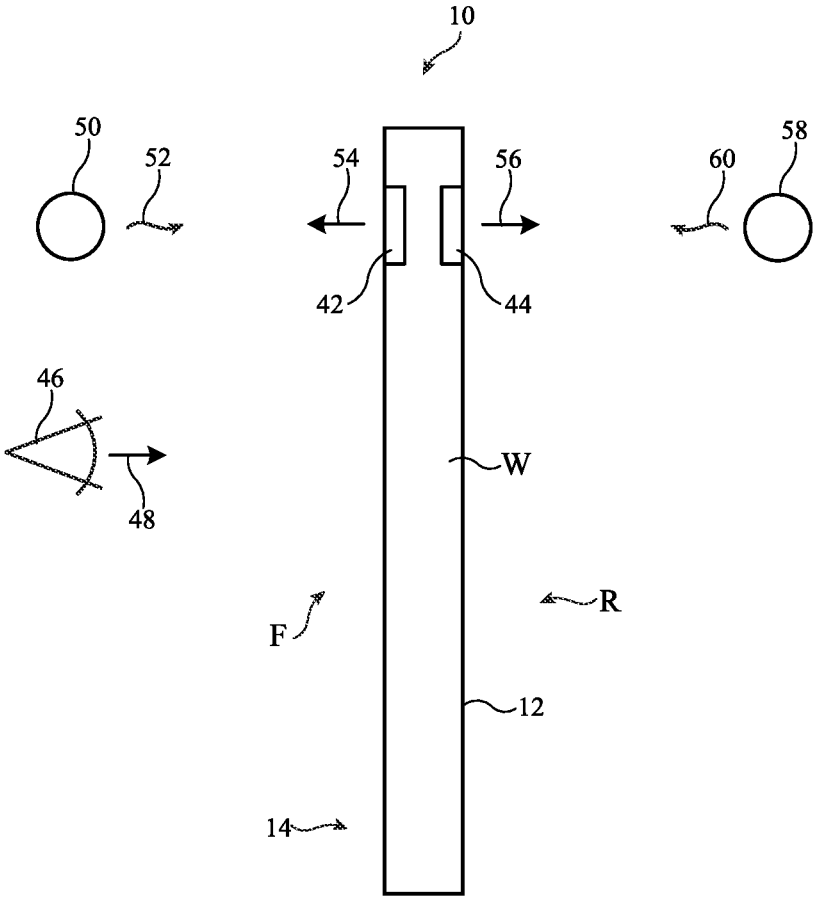
FIG. 4 is a cross-sectional side view of an illustrative electronic device with a front ambient light sensor and one or more supplemental ambient light sensors in accordance with an embodiment.

A cross-sectional side view of device 10 of FIG. 3 is shown in FIG. 4. As shown in FIG. 4, portions of housing 12 may be formed on front face F and opposing rear face R. Sidewall portions of housing 12 such as sidewalls W may extend between front face F and rear face R. Display 14 has pixels that display an image viewable on front face F (e.g., an image viewable through optional overlapping transparent portions of housing 12 that form a display cover layer on front face F). Front sensor 42 is mounted on front face F of housing 12 or elsewhere in device 10 that allows front sensor 42 to face outwardly from front face F (e.g., in direction 54, towards user 46). Front sensor 42 can therefore sense ambient light such as ambient light 52 from light source(s) 50 that are located in front of device 10.

Supplemental sensor 44 may be mounted on rear face R of housing 12 (as shown in the example of FIG. 4) or may otherwise be mounted on housing 12 to sense light in a different direction than front sensor 42. For example, supplemental sensor 44 may face outwardly from rear face R (e.g., in direction 56, away from rear face R and away from user 46). This allows rear sensor 44 to measure ambient light 60 from light source(s) 58 to the rear of device 10. By gathering ambient light measurements in multiple directions, control circuitry 30 can make satisfactory dynamic adjustments to display 14 such as intensity adjustments, color adjustments (e.g., white point adjustments), and/or other adjustments to display 14 during operation of device 10. For example, dynamic display brightness adjustments may be made to ensure that images are sufficiently bright for the user's lighting environment. Additionally, dynamic white point adjustments may be made to ensure that images that are presented on display 14 for user 46 are pleasing to the eye and are not too warm or too cold for the user's lighting environment.

As a user views display 14 on front face F, some ambient illumination in the user's environment may come from behind device 10. For example, device 10 may be used indoors near a window. The window may allow bright cool daylight (e.g., from light source 58 such as the sun) into the user's viewing environment. As the user views images on display 14, the user's eyes will adapt to the relatively bright cool daylight from the window. If the brightness and/or color cast of display 14 is not adjusted, the difference between the color and brightness of the ambient window light and the color cast and brightness of the image on display 14 may be unsettling to the user (e.g., the image on display 14 will appear too warm and/or may be insufficiently bright). To ensure that an image on display 14 is pleasing to the user in this scenario, control circuitry 30 may automatically adjust (e.g., increase) the brightness of display 14 based on the brightness of the ambient window light 60 from light source 58 and/or may automatically adjust the white point of display 14 to a colder value based on the color of ambient window light 60 from light source 58. At night, when the window behind device 10 is dark, the user's viewing environment may be lit by indoor light sources (e.g., light source 50), such as a warm incandescent light source in front of display 14. In these lighting conditions, the user's eyes will adapt to the dim and warm ambient light that is present, and control circuitry 30 may automatically adjust (e.g., reduce) the brightness of display 14 based on the brightness of the\light 52 from light source 50 and/or may automatically adjust the white point of display 14 to a warmer value based on the color of light 52 from light source 50 to ensure that images on display 14 are pleasing to the user.

The illustrative example of using device 10 indoors near a window is merely illustrative. Other scenarios in which the user's ambient lighting environment may be dominated by a light source behind device 10 include using device 10 in a vehicle, using device 10 outdoors (e.g., pointing a rear-facing camera in device 10 towards a bright outdoor scene such as a sunset), using device 10 in a dim indoor environment near a lamp that is behind device 10, etc. Arrangements in which supplemental sensor 44 is on a top sidewall W of housing 12 (e.g., as shown in the example of FIG. 1) may be beneficial for detecting a dominant light source in arrangements where device 10 is held more horizontal than vertical. For example, the user may view display 14 while holding device 10 horizontal to the ground (or otherwise not vertical to the ground). In this type of scenario, supplemental sensor 44 on top sidewall W can be used to measure ambient light brightness in the direction that is faced by top sidewall W. Control circuitry 30 may use this top sensor brightness value to adjust the brightness of display 14 when the measurements from sensor 44 and sensor 42 indicate that the user's ambient light viewing environment is dominated by a light source in the direction faced by top sidewall W.

Often user 46 will use display 14 in an ambient lighting environment that has a mixture of light sources. For example, warm and/or cold light with a first brightness may be present to the rear of device 10 and warm and/or cold light with a second brightness may be present to the front of device 10. In these mixed lighting conditions, control circuitry 30 can perform weighting operations or other operations that allow color and/or brightness measurements from front sensors 42 and 44 to be combined, or control circuitry 30 may select a given one of the color and/or brightness measurements from sensors 42 and 44. Control circuitry 30 may then adjust the brightness and/or color of display 14 based on the combined measurement or based on the selected measurement from a given one of sensors 42 and 44. In other words, the color cast of display 14 may be adjusted based on an ambient light color measurement from front sensor 42, may be adjusted based on an ambient light color measurement from supplemental sensor 44, and/or may be adjusted based on a combined measurement resulting from weighting the front sensor data and supplemental sensor data. Similarly, the brightness of display 14 may be adjusted based on an ambient light brightness measurement from front sensor 42, may be adjusted based on ambient light brightness measurement from supplemental sensor 44, and/or may be adjusted based on a combined measurement resulting from weighting the front sensor data and supplemental data.

In many scenarios, a user's viewing environment may be dominated by the brightest light source in the environment. If desired, control circuitry 30 may obtain ambient light brightness readings from front sensor 42 and from supplemental sensor 44 and may compare the two readings to determine which measurement has a greater luminance value. Control circuitry 30 may automatically adjust the brightness of display 14 based on the greater of the two luminance values. If desired, control circuitry 30 may apply power saving constraints such as applying a brightness cap and/or only taking into account the supplemental sensor reading in certain scenarios (e.g., when the supplemental intensity measurement is sufficiently greater than the front intensity measurement, when the front and supplemental intensity measurements are greater than respective thresholds, when other input-output devices 34 such as motion sensors and/or cameras indicate device 10 is being used in a rear-lit scenario, etc.).

During use of device 10 by a user, the user tends to persistently view display 14 in direction 48. As a result, the user's eyes can be more easily influenced by ambient light to the rear of device 10 than to the front of device 10.

Consider, as an example, a first illustrative scenario in which front light 52 is brighter than rear light 60. In this type of scenario, which may sometimes be referred to as a front-lit scenario, a front sensor luminance value may be used to determine the brightness of display 14. For example, control circuitry 30 may input the sensor luminance reading from front sensor 42 (e.g., instead of the sensor luminance reading from supplemental sensor 44) into a function that maps sensor readings to display brightness values.

In a second illustrative scenario, rear light 60 is brighter than front light 52. In this type of scenario, which may sometimes be referred to as a rear-lit scenario, the rear sensor luminance value measured using supplemental sensor 44 may be used to determine the brightness of display 14. For example, control circuitry 30 may input the sensor luminance reading from supplemental sensor 44 (e.g., instead of the sensor luminance reading from front sensor 42) into a function that maps sensor readings to display brightness values.

Figure 5:
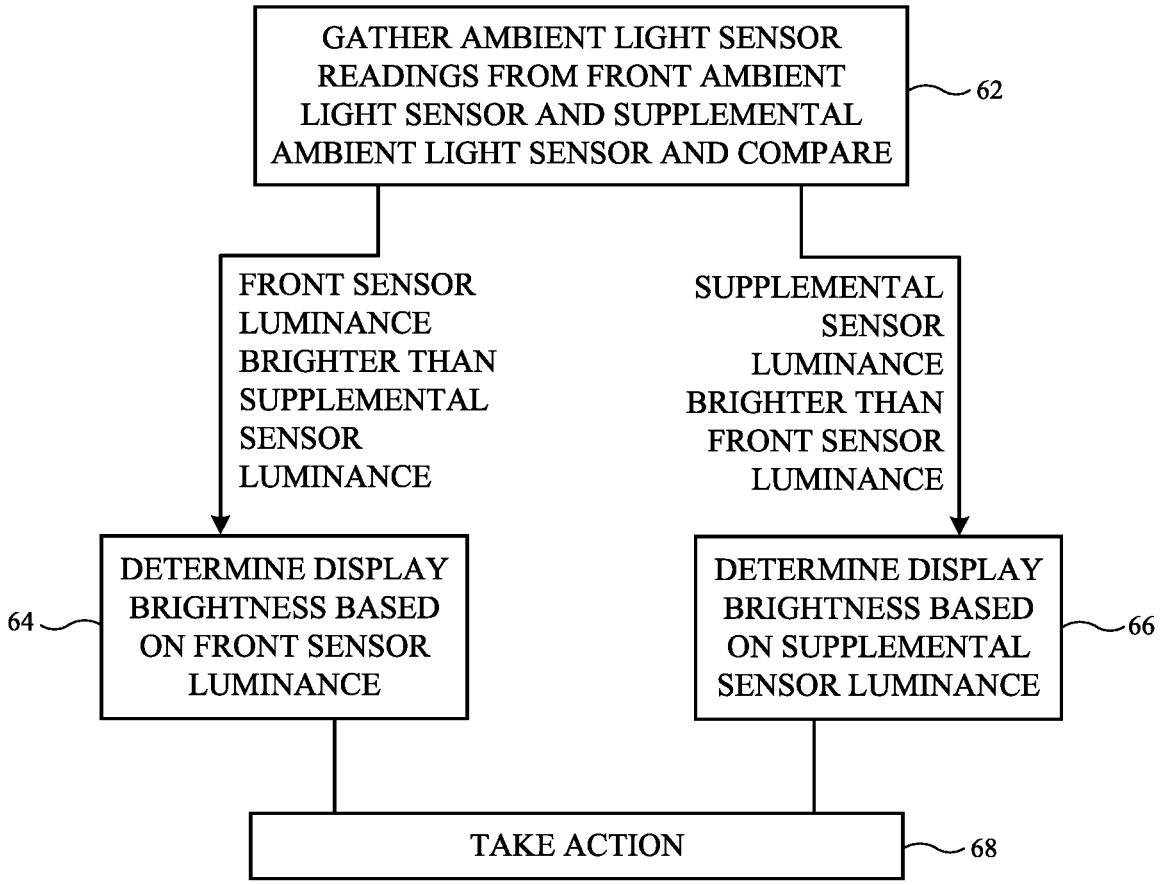
FIGS. 5 and 6 are flow charts of illustrative steps involved in using ambient light sensor information from front and supplemental ambient light sensors to make display adjustments in accordance with embodiments.

A flow chart of illustrative operations involved in using ambient light readings from front sensor 42 and supplemental sensor 44 is shown in FIG. 5. During the operations of block 62, control circuitry 30 may gather ambient light sensor readings from front ambient light sensor 42 and from supplemental ambient light sensor 44. Each reading may include an ambient light luminance (light intensity) value (and, if desired, an ambient light color value). The front and rear intensities may be compared to determine whether the magnitude of the ambient light to the rear of device 10 (or upwards of device 10 in arrangements where sensor 44 is on an upper wall W of housing 12, as shown in the example of FIG. 1) is greater than or less than the magnitude of the ambient light to the front of device 10.

If the light intensity reading of supplemental sensor 44 is greater than the light intensity reading of front sensor 42, control circuitry 30 can conclude that device 10 is being operated in a rear-lit scenario (e.g., in which the dominant light source in the user's viewing environment is behind or otherwise not in front of device 10). In this type of scenario, the rear sensor luminance value measured using supplemental sensor 44 may be used to determine the brightness of display 14 (see, e.g., the operations of block 66). This may include, for example, inputting the sensor luminance reading from supplemental sensor 44 (e.g., instead of the sensor luminance reading from front sensor 42) into a function that maps sensor readings to display brightness values.

If the light intensity of front sensor 42 exceeds that of supplemental sensor 44, control circuitry 30 can conclude that device 10 is being operated in a front-lit scenario (e.g., in which the dominant light source in the user's viewing environment is in front of device 10). In this type of scenario, the front sensor luminance value may be used to determine the brightness of display 14 (see, e.g., the operations of block 64). This may include, for example, inputting the sensor luminance reading from front sensor 42 (e.g., instead of the sensor luminance reading from supplemental sensor 44) into a function that maps sensor readings to display brightness values.

After determining the appropriate brightness value for display 14, control circuitry 30 may adjust the brightness of display 14 accordingly during the operations of block 68. If desired, control circuitry 30 may make other adjustments based on one or more of the sensor readings from sensors 42 and 44, such as white point adjustments for display 14, white point adjustments for cameras in device 10, adjustments to camera flash color casts, and/or adjustments to other optical components in device 10.

Because supplemental sensor 44 may face relatively bright light sources in many common scenarios, always adjusting the display brightness based on the bright ambient light measured by supplemental sensor 44 may result in excessive power consumption in device 10. If desired, power saving restrictions may be implemented to ensure that the operation of display 14 does not consume excessive power during use of device 10. For example, control circuitry 30 may impose restrictions that limit when the sensor reading from supplemental sensor 42 is taken into account for display brightness adjustments and/or may impose a brightness cap that limits the maximum brightness of display 14 in rear-lit scenarios.

Figure 6:
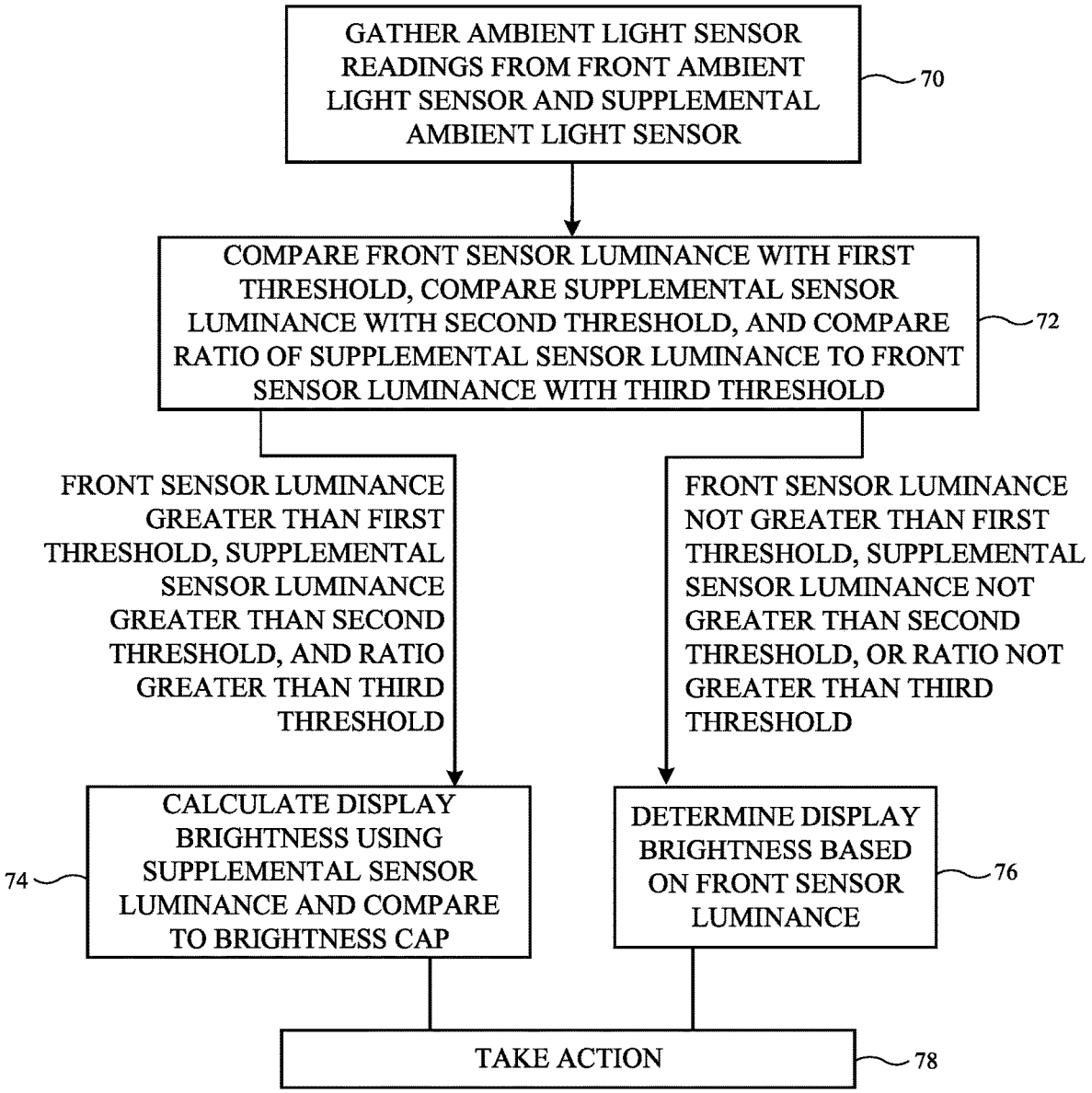

A flow chart of illustrative operations involved in implementing illustrative power saving restrictions when using ambient light readings from front sensor 42 and supplemental sensor 44 is shown in FIG. 6.

During the operations of block 70, control circuitry 30 may gather ambient light sensor readings from front ambient light sensor 42 and from supplemental ambient light sensor 44. Each reading may include an ambient light luminance (light intensity) value (and, if desired, an ambient light color value).

During the operations of block 72, control circuitry 30 may compare the front sensor luminance from front sensor 42 with a first threshold (e.g., a front threshold luminance value), may compare the supplemental sensor luminance from supplemental sensor 44 with a second threshold (e.g., a supplemental threshold luminance value), and may compare a ratio of the supplemental sensor luminance to the front sensor luminance with a third threshold (e.g., a non-zero value such as 2, 3, 4, 5, 6, greater than 1, greater than 2, greater than 6, less than 6, etc.). The first threshold (e.g., the front threshold luminance value) may be 50 lux, 80 lux, 100 lux, 200 lux, 500 lux, less than 500 lux, more than 500 lux, or any other suitable luminance value. The second threshold (e.g., the supplemental threshold luminance value) may be 500 lux, 800 lux, 1000 lux, 1200 lux, greater than 1200 lux, less than 1200 lux, or any other suitable luminance value. If desired, the supplemental threshold value may be greater than the front threshold luminance value.

If either the front sensor luminance or the supplemental sensor luminance is too low (e.g., below their respective thresholds) or if the ratio of the supplemental sensor luminance to the front sensor luminance is less than the third threshold (for example, if the supplemental sensor luminance is less than five times the front sensor luminance, less than three times the front sensor luminance, less than two times the front sensor luminance, etc.), then control circuitry 30 may determine the brightness for display 14 based on the front sensor luminance (e.g., during the operations of block 76). This may include, for example, inputting the sensor luminance reading from front sensor 42 (e.g., instead of the sensor luminance reading from supplemental sensor 44) into a function that maps sensor readings to display brightness values.

If both the front sensor luminance and the supplemental sensor luminance are sufficiently bright (e.g., greater than their respective thresholds) and if the ratio of the supplemental sensor luminance to the front sensor luminance is greater than the third threshold (for example, if the supplemental sensor luminance is at least five times the front sensor luminance, at least three times the front sensor luminance, at least two times the front sensor luminance, etc.), then processing may proceed to the operations of block 74.

During the operations of block 74, control circuitry 30 may determine what the brightness of the display 14 would be using the supplemental sensor luminance (e.g., by inputting the sensor luminance reading from supplemental sensor 44 into a function that maps sensor readings to display brightness values to obtain a supplemental-sensor-based brightness value). Control circuitry 30 may compare this supplemental-sensor-based brightness value with a brightness cap. The brightness cap may be a fixed value or may be based on the front sensor luminance from front sensor 42. For example, the brightness cap may be some factor multiplied with what the display brightness would be if the display brightness were calculated based on the front sensor luminance from front sensor 42. Control circuitry 30 may determine what the brightness for display 14 would be using the front sensor luminance by inputting the sensor luminance reading from front sensor 42 into a function that maps sensor readings to display brightness values to obtain a front-sensor-based brightness value. Control circuitry 30 may multiply this front-sensor-based brightness value by a factor (e.g., 1.5, 2, 2.5 3, 4, etc.) to obtain the brightness cap. If the supplemental-sensor-based brightness value (i.e., the display brightness calculated based on the supplemental sensor luminance) is greater than the brightness cap, then control circuitry 30 may set the display brightness to the brightness cap. If the supplemental-sensor-based brightness value is less than the brightness cap, then control circuitry 30 may set the display brightness to the supplemental-sensor-based brightness value.

After determining the appropriate brightness value for display 14, control circuitry 30 may adjust the brightness of display 14 accordingly during the operations of block 78. If desired, control circuitry 30 may make other adjustments based on one or more of the sensor readings from sensors 42 and 44, such as white point adjustments for display 14, white point adjustments for cameras in device 10, adjustments to camera flash color casts, and/or adjustments to other optical components in device 10.

The power saving restrictions discussed in connection with FIG. 6 are merely illustrative. If desired, some of these restrictions may be implemented individually (e.g., the first and second thresholds may be imposed without imposing the third threshold, the third threshold may be imposed without imposing the first and second thresholds, the brightness cap may or may not be imposed, etc.). In some arrangements, different or additional restrictions may be applied to achieve power savings. For example, information from input-output devices 34 and/or communications circuitry 32 may be used to gather contextual information about the environment in which device 10 is being used, which in turn can be used to limit or allow when supplemental ambient light sensor data is taken into account. For example, control circuitry 30 may use input-output devices 34 (e.g., motion sensors, cameras, etc.) and/or communications circuitry 32 (e.g., global positioning system receiver circuitry, Bluetooth® communications circuitry, etc.) to determine when device 10 is being used in a car, when device 10 is being used to take a picture outdoors, when device 10 is being used indoors at night, etc. Based on this information, control circuitry 30 may determine when device 10 is likely operating in a rear-lit scenario and may limit use of supplemental ambient light sensor data to these scenarios to save power, if desired.

This is, however, merely illustrative. If desired, control circuitry 30 may not implement any power saving restrictions and/or may lift power saving restrictions in any suitable scenario. For example, if control circuitry 30 detects that device 10 is connected to a power source, control circuitry 30 may lift some or all power saving restrictions (e.g., by adjusting display brightness based on the brightest ambient light measurement regardless of whether the various threshold conditions discussed in connection with FIG. 6 are met).

Device 10 may gather and use personally identifiable information. It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having opposing front and rear faces;

a display on the front face;

a front ambient light sensor on the front face that is configured to gather a front ambient light intensity measurement;

a rear ambient light sensor on the rear face that is configured to gather a rear ambient light intensity measurement; and control circuitry configured to:

compare the front and rear ambient light intensity measurements;

determine a ratio of the rear ambient light intensity measurement to the front ambient light intensity measurement and compare the ratio to a third threshold;

adjust a display brightness based on the front ambient light intensity measurement when the front ambient light intensity measurement is greater than the rear ambient light intensity measurement and greater than a first threshold;

adjust the display brightness based on the front ambient light intensity measurement when the ratio is less than the third threshold; and adjust the display brightness based on the rear ambient light intensity measurement when the rear ambient light intensity measurement is greater than the front ambient light intensity measurement and greater than a second threshold, wherein the first and second thresholds are different.

2. The electronic device defined in claim 1 wherein the control circuitry is configured to determine a brightness cap based on the front ambient light intensity measurement.

3. The electronic device defined in claim 2 wherein the control circuitry is configured to compare the brightness cap to a brightness value that is based on the rear ambient light intensity measurement.

4. The electronic device defined in claim 3 wherein the control circuitry is configured to set the display brightness to the brightness cap when the brightness value is greater than the brightness cap and when the rear ambient light intensity measurement is greater than the front ambient light intensity measurement and greater than the second threshold.

5. The electronic device defined in claim 4 wherein the control circuitry is configured to set the display brightness to the brightness value when the brightness value is less than the brightness cap and when the rear ambient light intensity measurement is greater than the front ambient light intensity measurement and greater than the second threshold.

6. The electronic device defined in claim 2 wherein the control circuitry is configured to determine a brightness value based on the front ambient light intensity measurement and wherein the brightness cap is equal to a multiple of the brightness value.

7. The electronic device defined in claim 1 wherein the control circuitry is configured to adjust the display brightness based on the rear ambient light intensity measurement when the ratio is greater than the third threshold.

8. The electronic device defined in claim 7 wherein the third threshold is greater than two.

9. The electronic device defined in claim 1 further comprising a sensor configured to gather sensor data, wherein the control circuitry is configured to determine whether to use the front or rear ambient light intensity measurement based at least party on the sensor data, and wherein the sensor is selected from the group consisting of: a camera and a motion sensor.

10. An electronic device, comprising:

a housing having opposing front and rear faces;

a display on the front face;

a first ambient light sensor on the housing that is configured to gather a first ambient light intensity measurement;

a second ambient light sensor on the housing that is configured to gather a second ambient light intensity measurement, wherein the first and second ambient light sensors face in different directions; and control circuitry configured to:

compare the first ambient light intensity measurement with a first threshold;

compare the second ambient light intensity measurement with a second threshold;

compare a ratio of the second ambient light intensity measurement to the first ambient light intensity measurement with a third threshold; and adjust a display brightness based on whether the first ambient light intensity measurement is greater than the first threshold, the second ambient light intensity measurement is greater than the second threshold, and the ratio of the second ambient light intensity measurement to the first ambient light intensity measurement is greater than the third threshold.

11. The electronic device defined in claim 10 wherein the first ambient light sensor is mounted on the front face of the housing.

12. The electronic device defined in claim 11 wherein the second ambient light sensor is mounted on the rear face of the housing.

13. The electronic device defined in claim 11 wherein the housing comprises a sidewall that joins the front and rear faces on an upper portion of the housing and wherein the second ambient light sensor is mounted on the sidewall of the housing.

14. The electronic device defined in claim 10 further comprising a sensor configured to gather sensor data, wherein the control circuitry is configured to determine whether to use the first or second ambient light intensity measurement based at least party on the sensor data, and wherein the sensor is selected from the group consisting of: a camera and a motion sensor.

15. An electronic device, comprising:

a housing having front and rear faces joined by a sidewall;

a display mounted on the front face;

a first ambient light sensor on the front face that is configured to gather a first ambient light intensity measurement;

a second ambient light sensor on the sidewall that is configured to gather a second ambient light intensity measurement; and control circuitry configured to:

compare a ratio of the second ambient light intensity measurement to the first ambient light intensity measurement with a threshold;

adjust a display brightness based on the first ambient light intensity measurement when the ratio of the second ambient light intensity measurement to the first ambient light intensity measurement is less than the threshold; and adjust the display brightness based on the second ambient light intensity measurement when the ratio of the second ambient light intensity measurement to the first ambient light intensity measurement is greater than the threshold.

16. The electronic device defined in claim 15 wherein the control circuitry is configured to:

compare the first ambient light intensity measurement to a first threshold intensity;

compare the second ambient light intensity measurement to a second threshold intensity; and adjust the display brightness based on whether the first ambient light intensity measurement is greater than the first threshold intensity and the second ambient light intensity measurement is greater than the second threshold intensity.

17. The electronic device defined in claim 16 wherein the first threshold intensity is less than the second threshold intensity and wherein the threshold is greater than two.

* * * * *